US005946956A

United States Patent [19]

Hötzl

[11] Patent Number: 5,946,956

[45] Date of Patent: Sep. 7, 1999

[54] ELECTROMECHANICAL LOCK SYSTEM

[75] Inventor: Manfred Hötzl, Graz, Austria

[73] Assignee: Roto Frank Eisenwarenfabrik AG, Karlsdorf Bei Graz, Austria

[21] Appl. No.: 09/063,133

[22] Filed: Apr. 20, 1998

[30] Foreign Application Priority Data

Apr. 25, 1997 [AT] Austria ..... 703/97

[51] Int. Cl.[6] ..... E05B 47/00

[52] U.S. Cl. ..... 70/276; 70/278

[58] Field of Search ..... 70/337, 276–283

[56] References Cited

U.S. PATENT DOCUMENTS

| | | | |
|---|---|---|---|
| 4,068,507 | 1/1978 | Peterson | 70/271 |
| 4,225,008 | 9/1980 | Colell | 70/237 X |
| 4,458,512 | 7/1984 | Gelhard | 70/277 |
| 4,924,686 | 5/1990 | Vonlenthen | 70/277 |
| 5,202,580 | 4/1993 | Janssen | 70/276 X |
| 5,373,718 | 12/1994 | Schwerdt et al. | 70/278 |
| 5,394,718 | 3/1995 | Hotzel | 70/279 |
| 5,404,737 | 4/1995 | Hotzel | 70/279 |
| 5,469,727 | 11/1995 | Spahn et al. | 70/278 |
| 5,552,777 | 9/1996 | Gokcebay et al. | 70/278 X |

FOREIGN PATENT DOCUMENTS

| | | |
|---|---|---|
| 399 014 | 3/1995 | Austria . |
| 399 015 | 3/1995 | Austria . |
| 31 03 028 | 8/1982 | Germany . |

*Primary Examiner*—Suzanne Dino Barrett
*Attorney, Agent, or Firm*—Herbert Dubno; Andrew Wilford

[57] ABSTRACT

An electromechanical lock system has a lock cylinder including a body, a rotatable core forming a key passage, and carrying at least one magnet, tumblers engageable between the core and the body and shiftable between positions blocking rotation of the core in the body and freeing positions permitting such rotation, a sensor juxtaposable with the magnet in an angular position of the core in the body, anda coupling member juxtaposed with an inner end of the core, forming an inner extension of the passage, and rotatable in the body independently of the core. A mechanically operable element is coupled mechanically to the coupling member and an electrically operable element is coupled electrically to the sensor. A long key engageable in the passage has a bitting fittable with the tumblers to set same in the freeing positions and is of a length sufficient to reach into the coupling member so that insertion of the long key fully into the passage and subsequent rotation of the key turns the core and the coupling member to operate both the mechanical and electrical elements. A short key engageable in the passage has a bitting fittable with the tumblers to set same in the freeing positions and is of a length insufficient to reach into the coupling member so that insertion of the short key fully into the passage and subsequent rotation of the key turns only the core to operate only the electrical element while not operating the mechanical element.

5 Claims, 1 Drawing Sheet

ELECTROMECHANICAL LOCK SYSTEM

SPECIFICATION

1. Field of the Invention

The present invention relates to a lock system. More particularly this invention concerns a key-operated lock that can operate mechanical and electrical elements.

2. Background of the Invention

U.S. Pat. No. 5,394,718 of Hotzl describes a lock assembly that has a main lock housing, a bolt movable in the housing between a locked position projecting from the housing and an unlocked position largely recessed in the housing, a key-operable mechanism having an actuator movable by turning of an appropriately bitted key in the mechanism, and a linkage between the actuator and the bolt for displacing the bolt by means of the actuator. A secondary housing is provided adjacent the lock housing and an actuator element coupled and movable with the linkage extends from the lock housing to the secondary housing. The element moves in one direction relative to the secondary housing on movement of the bolt from the locked to the unlocked position and in the opposite direction on movement of the bolt from the unlocked to the locked position. An electric motor on the secondary housing connected to the element is energizable for displacing same in both directions and thereby also displacing the bolt between its positions. Switches on the secondary housing juxtaposed with the element and connected to the motor detect movement of the element in either direction when actuated through the linkage by the key and energize the motor to move the element in the same direction it is already moving in. Thus the motor gives the key a sort of power assist.

U.S. Pat. No. 5,404,739 also of Hotzl describes another lock assembly that has a main lock housing, a bolt movable in the housing between a locked position projecting from the housing and an unlocked position largely recessed in the housing and a double cylinder having an outside key-operable part rotatable by an appropriately bitted key and an inside part rotatable by the outside part and also rotatable independently of the outside part. The inside part carries an actuator movable on rotation of either part. A gear linkage between the actuator and the bolt displaces the bolt. A secondary housing is provided adjacent the lock housing and an actuator element coupled and movable with the linkage extends from the lock housing to the secondary housing. The element moves relative to the secondary housing on movement of the bolt between its positions. An electric motor on the secondary housing connected to the element is energizable for displacing same and thereby also displacing the bolt between its positions. A key-operated switch connected to the electric motor energizes this motor to allow electrical as well as manual actuation of the locking element.

Austrian patent 399,014 describes a double-cylinder core with one of its cylinders devoid of tumblers and provided with a manually actuatable knob. An electric motor in the housing is switchable with respect to its rotation direction and a rod connects the motor with the lock mechanism, that is the housing with the latch housing, in order to carry out the locking function.

In Austrian patent 399,015 there is a key switch with a cylinder whose locking member operates various contacts. If a locking procedure is not completed spring-loaded abutments in the lock shift the locking member so as to signal to the person turning the key that something has gone wrong German patent document 3,103,028 of Kopperschlager has a motor-vehicle door lock that can be differently operated by two different keys. One of the keys is purely mechanical and operates by means of standard edge bitting on standard tumblers. The other key is of the same size and shape but carries small magnets that interact with magnetic sensors in the lock to control further functions.

U.S. Pat. No. 4,068,507 of Peterson shows a limited access lock that uses two-different keys. A special rod or tumbler in the lock only interacts with one of the keys to block the lock when not retracted, so the lock can be set not to work with the other key.

In U.S. Pat. No. 4,225,008 of Colell describes a system where two differently shaped keys act differently on the structure of the lock cylinder.

All these arrangement are relatively complex and often entail the total redesign of the lock cylinder for their application.

OBJECTS OF THE INVENTION

It is therefore an object of the present invention to provide an improved electromechanical lock system.

Another object is the provision of such an improved electromechanical lock system which overcomes the above-given disadvantages, that is which is simpler than the prior-art systems and that can easily be adapted to an existing lock cylinder.

SUMMARY OF THE INVENTION

An electromechanical lock system has according to the invention a lock cylinder including a body, a core forming a key passage, rotatable in the body about an axis, and carrying at least one magnet, tumblers engageable between the core and the body and shiftable between positions blocking rotation of the core in the body and freeing positions permitting such rotation, a sensor juxtaposable with the magnet in an angular position of the core in the body, and a coupling member juxtaposed with an inner end of the core, forming an inner extension of the passage, and rotatable in the body independently of the core about the axis. A mechanically operable element is coupled mechanically to the coupling member and an electrically operable element is coupled electrically to the sensor. A long key engageable in the passage has a bitting fittable with the tumblers to set same in the freeing positions and is of a length sufficient to reach into the coupling member so that insertion of the long key fully into the passage and subsequent rotation of the key turns the core and the coupling member to operate both the mechanical and electrical elements. A short key engageable in the passage has a bitting fittable with the tumblers to set same in the freeing positions and is of a length insufficient to reach into the coupling member so that insertion of the short key fully into the passage and subsequent rotation of the key turns only the core to operate only the electrical element while not operating the mechanical element.

Thus with this system the long key can at any time operate both the mechanical element, for instance a deadbolt, and the electrical element, for instance a motor acting on the latch bolt. Thus it is possible for a person with the long key to secure the lock with a mechanical dead bolt, in effect locking out the persons with the short keys. Such a system is useful for am employer who wants to secure his premises, even against his employees, outside working hours.

The lock can also be provided with an internal slider that shifts to connect the coupling member to the cylinder core, although in the simplest embodiment the key itself actually forms the rotary link. Such a system is easily adapted to current key systems.

According to the invention the cylinder includes a second such core forming a second key passage, rotatable in the body about the an axis, and carrying at least one second magnet. Second tumblers engageable between the second core and the body are shiftable between positions blocking rotation of the second core in the body and freeing positions permitting such rotation. A second sensor is juxtaposable with the second magnet in an angular position of the second core in the body. The coupling member juxtaposed with an inner end of the second core forms an inner extension of its passage.

In accordance with the invention a knob connected to the core is rotatable therewith for manual actuation of the core. A double-core system can easily be adapted to use of an inside knob by elimination of the tumblers of the inside or second core and mounting of the knob right on the inside core.

The electrical element according to the invention includes an electrical strike and the knob is provided with a switch button for directly actuating the strike. The short key has an overall length at most equal to a length of the passage in the core.

BRIEF DESCRIPTION OF THE DRAWING

The above and other objects, features, and advantages will become more readily apparent from the following description, reference being made to the accompanying drawing in which.

SPECIFIC DESCRIPTION

Figures 1, 2:
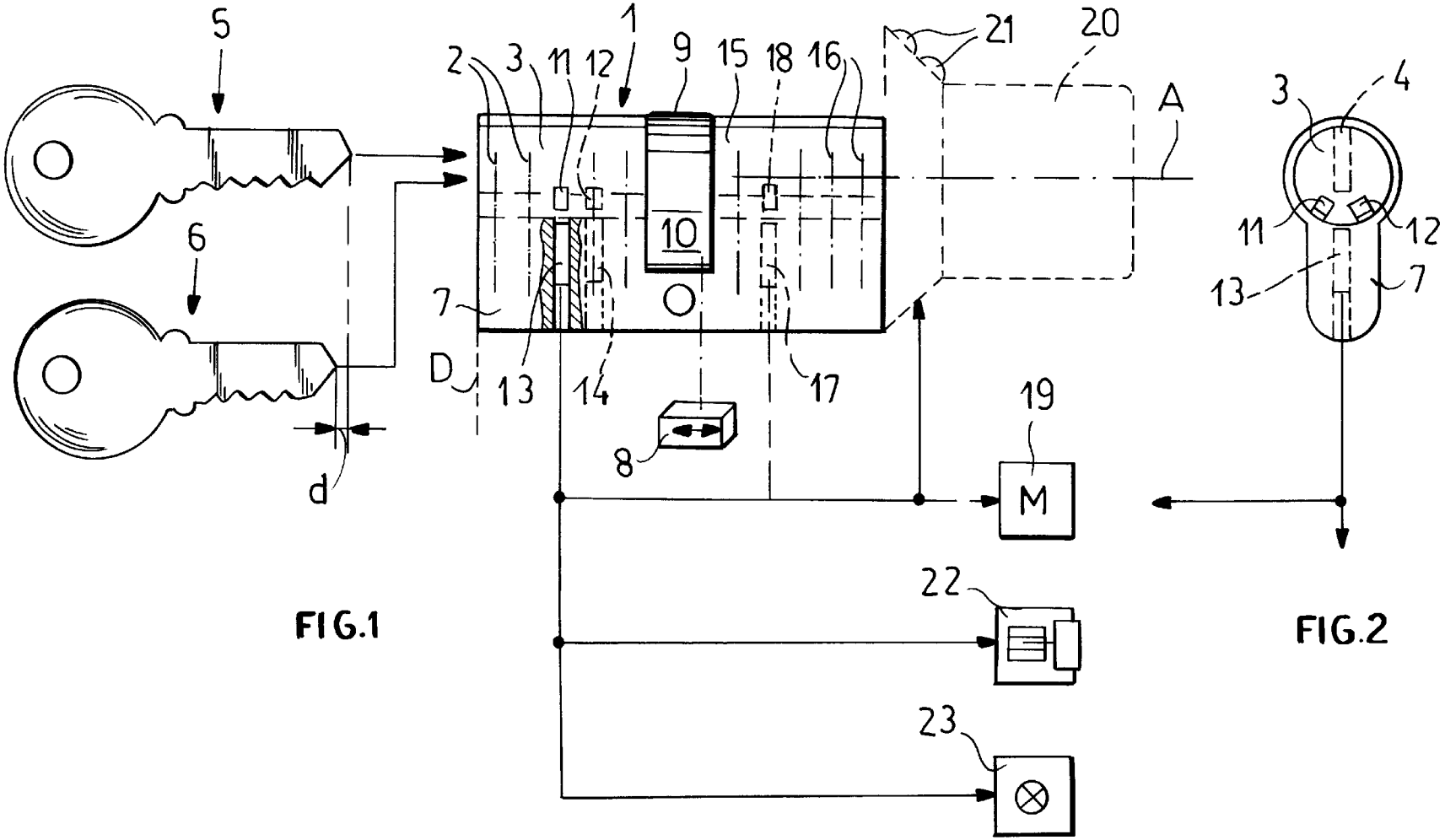
FIG. 1 is a largely schematic view of the lock system according to the invention.
FIG. 2 is an end view of the lock cylinder of FIG. 1.

As seen in FIGS. 1 and 2 a lock system according to the invention has a lock cylinder 1 comprised of a barrel or core 3 rotatable about an axis A in a body 7 normally fixed in a door shown schematically at D. The barrel 3 forms a key passage 4 and is normally arrested against rotation by tumblers 2 and carries magnets 11 and 12 that can coact with angularly offset reed switches 13 and 14. The cylinder body 7 carries at an inner end of the barrel 3 a coupling element or ring 9 that can rotate in the body 7 about the axis A and that has a projection 10 that is mechanically connected to a bolt mechanism shown schematically in part at 8. This coupling ring 9 is not normally coupled to the cylinder core 3 and can normally therefore rotate relative to it. Internally it forms a continuation of the key passage 4, having the same cross-sectional shape as this passage 4.

In this embodiment the body 7 holds coaxial with the barrel 3 a second barrel 15 normally arrested by tumblers 16 and having at least one magnet 18 that can coact with a reed switch or similar sensor 17. The barrel 15 can rotate relative to and coaxially with the barrel 3 and is normally accessible from inside the door D carrying the lock 1.

The switches or sensors 13, 14 and 17 can operate a motor shown schematically at 19 that serves to extend and retract bolts in the door D carrying the lock 1 and/or that serves as a power-assist for operation of the lock as discussed above. Alternately or in addition these switches 13, 14, and 17 can operate an electric strike shown at 22 or another device such as shown schematically at 23, as for instance shutters on a shop window. In any case the mechanical ring 9 operates the mechanical bolt 8 which can be a standard door deadbolt.

According to the invention a pair of different keys 5 and 6 are provided that have identical bitting, but the key 6 is shorter than the key 5 by a distance d. Thus when the short key 6 is fully inserted in the passage 4 it will not reach to the coupling ring 9 while the long key 5 is capable of reaching into this ring 9. As a result the key 5 can only rotate the core 3 and thereby actuate the switches 13 and 14, but cannot operate the mechanical element 8. The longer key 6 can operate both the switches 13 and 14 as well as the mechanical element 9. Thus it is possible to have the standard spring-loaded door latch bolt controlled by the barrel 3, but to have the door dead bolt controlled by the ring 9. Thus a person with the long key 5 can lock out a person with the short key 6.

In the illustrated double embodiment the keys 5 and 6 operate identically in the cylinder core 15, that is with the short key 6 only turning this core 15 but the long key 5 being able to turn the core 15 and operate the ring 9.

In addition FIG. 2 shows in dot-dash lines how a knob 20 can be provided on the inside face of the door D. This knob 20 is coupled to the core 15 and the tumblers 16 are eliminated so it can turn the core 15 freely to operate the electrical elements 19, 22, and 23 from inside the door. Input buttons 21 are provided on the knob 20 for individually operating the elements 19, 22, and 23.

I claim:

1. An electromechanical lock system comprising:

a lock cylinder including a body, a core forming a key passage, rotatable in the body about an axis, and carrying at least one magnet, tumblers engageable between the core and the body and shiftable between positions blocking rotation of the core in the body and freeing positions permitting such rotation, a sensor juxtaposable with the magnet in a predetermined angular position of the core in the body, and a coupling member juxtaposed with an inner end of the core, forming an inner extension of the passage, and rotatable in the body independently of the core about the axis;

a mechanically operable element coupled mechanically to the coupling member;

an electrically operable element coupled electrically to the sensor;

a long key engageable in the passage, having a bitting fittable with the tumblers to set the tumblers in the freeing positions, and having a length sufficient to reach into the coupling member, whereby insertion of the long key fully into the passage and subsequent rotation of the key turns the core and the coupling member to operate both the mechanical and electrical elements; and a short key engageable in the passage, having a bitting fittable with the tumblers to set the tumblers in the freeing positions, and having a length insufficient to reach into the coupling member, whereby insertion of the short key fully into the passage and subsequent rotation of the key turns only the core to operate only the electrical element while not operating the mechanical element.

2. The electromechanical lock system defined in claim 1 wherein the cylinder includes a second such core forming a second key passage, rotatable in the body about the axis, and carrying at least one second magnet, second tumblers engageable between the second core and the body and shiftable between positions blocking rotation of the second core in the body and freeing positions permitting such rotation, and a second sensor juxtaposable with the second magnet in an angular position of the second core in the body, the coupling member juxtaposed with an inner end of the second core and forming an inner extension of the passage thereof.

3. The electromechanical lock system defined in claim 1, further comprising a knob connected to the core and rotatable therewith for manual actuation of the core.

4. The electromechanical lock system defined in claim 3 wherein the electrical element includes an electrical strike and the knob is provided with a switch button for directly actuating the strike.

5. The electromechanical lock system defined in claim 1 wherein the short key has an overall length at most equal to a length of the passage in the core.

* * * * *